United States Patent [19]

Ferrage

[11] 4,411,082

[45] Oct. 25, 1983

[54] LAUNDRY IRONING DEVICE WITH PIVOTED BLADE FOLDER

[75] Inventor: François Ferrage, La Rivieve-de-Corps, France

[73] Assignee: Dubix, Saint Julien les Villas, France

[21] Appl. No.: 309,761

[22] Filed: Oct. 8, 1981

[51] Int. Cl.[3] ..... D06F 65/10

[52] U.S. Cl. ..... 38/9; 38/2; 493/419

[58] Field of Search ..... 38/9, 2; 493/419, 444, 493/442, 414, 413

[56] References Cited

U.S. PATENT DOCUMENTS

| | | | |
|---|---|---|---|
| 1,440,862 | 1/1923 | Benjamin | 38/9 |
| 1,941,131 | 12/1933 | Westwood | 38/9 |
| 2,368,652 | 2/1945 | Forse | 38/9 |
| 2,914,320 | 11/1959 | Petre | 493/444 X |
| 2,954,974 | 10/1960 | Kellett | 38/2 X |
| 3,031,780 | 5/1962 | Fredholm | 493/444 X |
| 3,795,995 | 3/1974 | Johnson | 38/2 |

*Primary Examiner*—Werner H. Schroeder
*Assistant Examiner*—Andrew M. Falik
*Attorney, Agent, or Firm*—Larson and Taylor

[57] ABSTRACT

A drying and ironing device for a textile element includes in addition to a conventional drying and ironing system, an integral folding device. The folding device comprises a folding blade which is mounted to pivot in a reciprocating manner on a support moved by an electrical jack, below and flush with either side of the textile element hanging down under the effect of gravity on discharge from the drying and ironing system. An infrared transmitter-receiver cell detects the beginning and the end of this textile element and an electronic device generates and counts "pips" triggered by this cell. The folding device also includes an arrangement for gripping and removing the folded textile element.

3 Claims, 9 Drawing Figures

LAUNDRY IRONING DEVICE WITH PIVOTED BLADE FOLDER

FIELD OF THE INVENTION

The present invention relates to a drying and ironing device, in particular for the industrial treatment of long flat textile elements.

BACKGROUND OF THE INVENTION

It is known that modern drying and ironing devices, designed to dry and iron textile elements (linen, sheets, woven materials, synthetic materials in the form of cloth or in any other form, whether woven or not) comprise a cylinder on which the textile element is stretched, dried and ironed.

Some of these machines comprise a heated tank and a non-heated cylinder. Others, of a smaller size, are not provided with a heated tank and comprise a heated cylinder. This heated cylinder may be fixed or rotary according to the type of machine. In these machines the input and output of the textile element takes place at the front, which facilitates handling, and the cylinder is heated internally by means of a heat source, supplied by gas, steam, electricity or any other suitable means or fluid. The textile element is introduced at the top, applied to the heated cylinder and entrained by an endless belt or by a system of endless strips, whether connected or spaced, distributed over the entire width of the cylinder. The belt or the strips are guided and/or entrained by auxiliary cylinders and the textile element, after having been dried and ironed, emerges at the bottom at the front of the machine and is collected in bulk in a front receiving container.

After removal from this container, textile elements which exceed certain dimensions must then be folded, this being carried out industrially by passing the textile elements through a folder or a folding device, or, in the case of small-scale operations, by hand. In both cases the required handling of the textile elements increases the cost of the operation. In the first case the gain in efficiency is accompanied by additional investment costs in machinery which affects the cost of the operation as a whole.

SUMMARY OF THE INVENTION

The drying and ironing device of the invention enables, by means of its incorporated folding device, the elimination of this handling and the elimination of manual folding or the use of an auxiliary folding machine and therefore also reduces operating costs, in particular in the case of industrial blenching of bed linen, and is particularly adapted to the treatment (drying, ironing and folding) of sheets.

In a conventional manner, the drying and ironing device comprises a drying and ironing system, in particular using a heated cylinder, into which the textile element, in particular a sheet, is inserted and entrained, and at the output of which the textile element hands down under the effect of gravity.

The device is characterized in that it incorporates a device for folding the textile element, this folding device including a transverse folding blade, fixed to a transverse support pivoting about a shaft disposed in a transverse manner in a lower portion of the said drying and ironing device. This blade is adapted for reciprocating movement and is rocked between two limit positions by the action of a double-acting jack, in particular an electrical jack, the blade and support being disposed below and flush with the output of the drying and ironing system constituted by the last auxiliary cylinder or roll of a series of such cylinders. The folding device also includes a system for gripping and removing the textile element once it has been folded to straddle the folding blade, constituted by a guide path formed by endless strips tensioned about a frame and moved by a drive cylinder, and by a presser roll or presser wheels disposed in a transverse and freely rotatable manner at the end of a support pivoting about a transverse axis located below the receiver container and contacting the drive cylinder. A receiver container is disposed at the front of the device, under the engagement tank and the guide path in order to receive the dried, ironed and folded textile element. In addition, means are provided for automatically rocking the folding blade in one direction and then in the other, as soon as the textile element, on discharge from the drying and ironing system, has unrolled by a given length corresponding to the formation of a fold on one side or the other of the folding blade, and for stopping and starting the rocking of the folding blade at the end and beginning respectively of the process for folding the textile element, as well as for actuating the system for gripping and removing the folded textile element.

Further features and advantages of the invention are shown in more detail in the following description, with reference to the attached drawings which relate to a preferred embodiment of the drying and ironing device of the invention, given by way of non-limiting example.

DESCRIPTION OF THE PREFERRED EMBODIMENT

Figure 3:
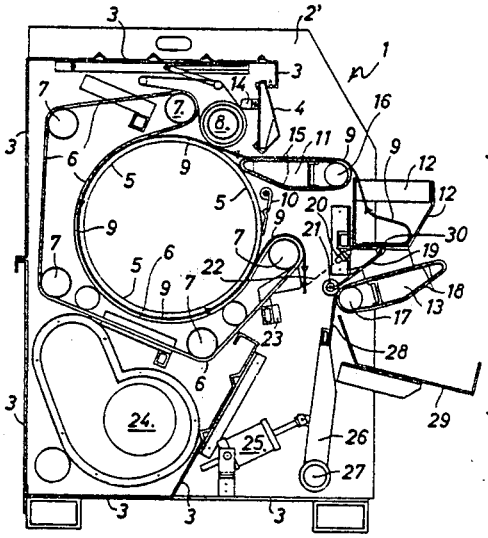
FIGS. 3 to 8 are cross-sections along the line A—A' of FIG. 1 through the drying and ironing device in six successive stages of operation.
Figure 4:
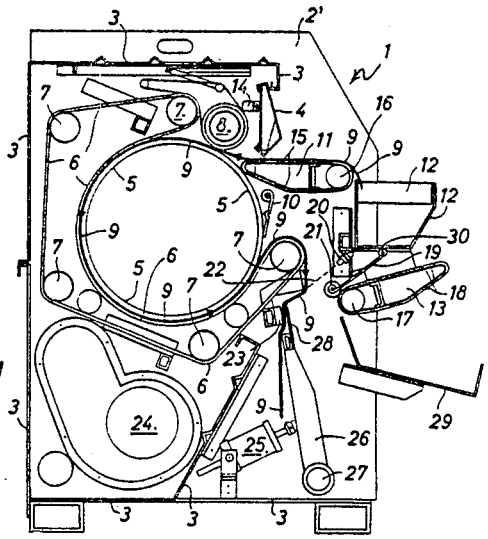
Figure 5:
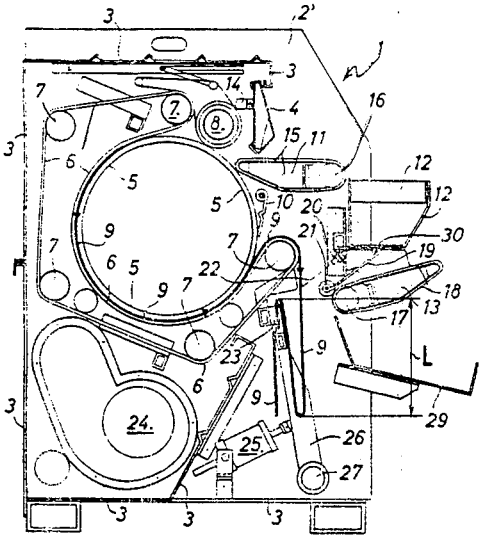
Figure 6:
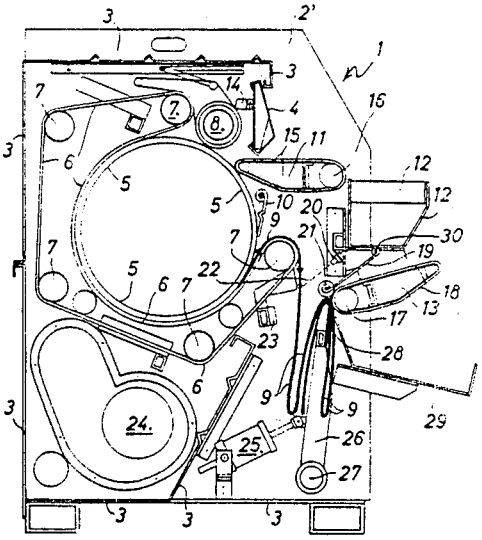
Figure 7:
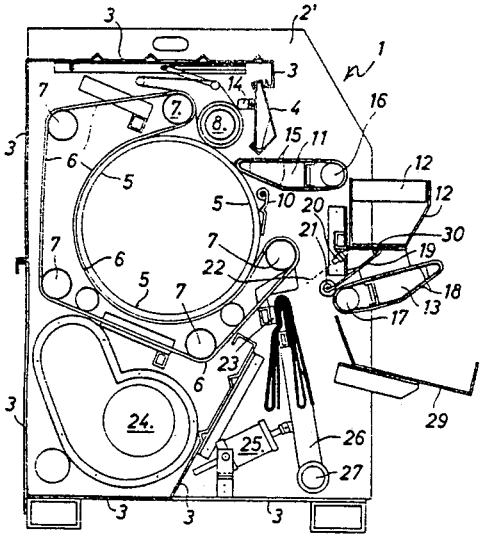
Figure 8:
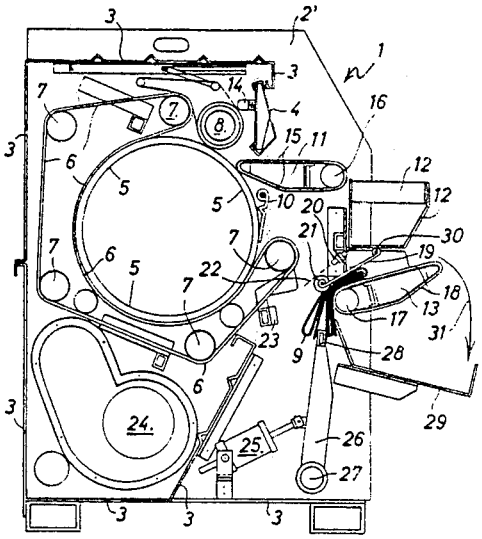

With reference to FIGS. 1 to 8, the drying and ironing device 1 comprises, in a manner known per se, disposed between its lateral edges 2 and 2' and accessible from the front of the machine and within its casing 3, 4 a conventional drying and ironing system, in this case a heated cylinder 5 provided with an endless belt or endless connected or spaced strips 6 distributed over the entire width of the heated cylinder 5. This belt or these strips 6 are guided and/or entrained by auxiliary rolls 7, while a drive cylinder 8 having endless strips tensioned by a tightener 14 grips the textile element to be dried and ironed 9 and applies it against the heated cylinder 5, the element 9 being presented, on its discharge from an engagement tank 12, on and by a guide path 11 formed from a frame about which endless drive strips 15 are tensioned and moved in translation about the frame by a drive cylinder 16. When introduced in this way between the heated cylinder 5 and the belt or strips 6, the textile element moves in the direction of the arrows shown in FIGS. 3 to 6 and, when dried and ironed, hangs under the effect of gravity at the output of the drying and ironing system (FIG. 3). A knife 10 prevents adhesion of the textile element 9 to the heated cylinder 5 on its discharge from the drying and ironing system and, also in a manner known per se, a fan 24 ensures that moist air is evacuated from the casing 3,4.

A description of the folding device will now be given. This is constituted, on one hand, by a transverse folding blade 28 fixed to a transverse support 26 which pivots about a shaft 27 disposed in a transverse manner in the lower portion of the drying and ironing device 1 and which, entraining the blade 28 in its movement, is reciprocally moved and rocked between two limit positions by a double-acting jack, in this case and advantageously, an electrical jack 25, and, on the other hand, by two transverse stops limiting the angular movement of the folding blade 28, which is therefore pivotably mounted and reciprocally moved under the outlet of the drying and ironing system, the stops being disposed on either side and flush with the portion of the textile element 9 hanging down under the effect of gravity. The said device is further constituted by a system for gripping and removing the textile element 9, the element having previously been folded to straddle the folding blade 28 as explained below, constituted, on one hand, by a guide path 13 formed from a frame about which are tensioned endless drive strips 18 moves in translation about the frame by a drive cylinder 17 and, on the other hand, by a presser roll, or presser wheels, 21 disposed in a transverse manner and freely rotatable at the end of a support 19 pivoting about a transverse shaft 30 located under the engagement tank 12 and coming into contact with the drive cylinder 17 simply under the effect of gravity or under the effect of recall means. This device is disposed in such a way that when rocked into its front limit position, the upper edge of the folding blade 28 is substantially in the tangential line of the cylinder 17 and the presser roll or wheels 21.

The two transverse stops mentioned above are constituted firstly by a rear transverse contact bar 23 and secondly, at the front, by the drive cylinder 17 which is maintained in the stop position during the folding process.

Means are provided for automatically rocking the folding blade 28, for starting and stopping the rocking and for actuating the system for gripping and removing the folded textile element 9. They comprise, on one hand, a detector which enables the detection of the begenning and end of the textile element 9 on discharge from the drying and ironing system. This detector is constituted by at least one infrared transmitter-receiver cell 20 disposed in the median plane of the drying and ironing device 1 and orientated in this plane in such a way that its axis 22 of transmission and reception of infrared radiation contacts the textile element 9 substantially at the level at which it is gripped, as explained below, with a reciprocating movement by the upper edge of the folding blade 28. The infrared radiation transmitted by the cell 20 along its axis 22 is partially reflected by the surface of the textile element 9 along the same axis 22 and received again by the cell 20, which is also a receiver cell. Infrared radiation was selected in preference to other types of radiation, as a result of the fact that the textile element 9 is still hot at its discharge from the drying and ironing system due to its passage over the heated cylinder, which increases the reliability of its detection by this means.

The said means also comprise an electronic generator-counter device (not shown) for "pips" or square signals, which may be regulated as a function of the length of fold "L" (FIG. 5) desired, and controlled by the said detector.

This device for generating and counting "pips" is advantageously associated with a microprocessor system enabling, in particular by action of the frequency of transmission of these "pips," the achievement for textile elements of any length of a length of fold "L" which is constant whatever the speed of passage of this textile element 9 through the drying and ironing device.

Lastly, there is provided a reception tank 29 at the front, in order to enable the collection of the dried, ironed and folded textile element.

The operation of the incorporated folding device, with reference to its successive stages shown in FIGS. 3 to 9, is as follows:

Starting from FIG. 3, the beginning of the textile element 9 which is passed, on discharge from the drying and ironing system, the last auxiliary cylinder 7, hangs down under the effect of gravity and intersects the axis 22 of the infrared cell 20, is detected by the latter which triggers the counting of the "pips" by the said electronic device. As the folding blade 28 is contacted by a stop, namely the drive cylinder 17 which is at rest, the textile element 9, entrained by the belt or the strips 6, descends downwardly towards the rear (i.e. to the left in FIG. 3) of the blade 28 and its support 26. When the drop or overhang of the textile element 9 has reached the length of fold "L" (distance between two successive folds, see FIG. 5), the electronic device has counted the number of "pips" corresponding to this length "L" (for example 10 "pips") for which it has previously been regulated and then controls the action of the electrical jack 25 which rearwardly rocks the folding blade 28 which then pins the textile element 9 against the rear bar and thus enables the textile element 9 to unroll in front of the blade 28 and its support 26 by a length "2L" enabling the formation of a fold having two sections, which corresponds to twice the initial number of "pips" for the electronic counting device (in this case 20 pips) if the device is programmed with a constant "pip" frequency (or even to the same number of pips if it is programmed at a variable frequency). This counting of the pips causes, after unrolling of the length "2L" of the textile element 9 (FIG. 5), a further actuation, in the opposite direction of the electrical jack 25 which then rocks the folding blade 28 towards the front (to the right in FIG. 6), which blade 28 then grips the previously folded portion of the textile element against the drive cylinder 17 maintained in the stop position, which then enables the textile element 9 to unroll at the rear of the blade 28 and its support 26; by a length "2L" enabling the formation of a further fold having two sections, with the same counting conditions for the "pips" as in the case of the formation of the fold having two sections mentioned above. This further counting causes, after unrolling of the length "2L" of the textile element 9 (FIG. 6), a further actuation of the electrical jack 25 which then rocks the folding blade 28) towards the rear (FIG. 7) gripping the previously folded portion of the textile element 9 against the support bar 23, which enables the remainder of the textile element 9 to unroll and to fall towards the front of the folding blade 28 in order to form the last section of the length "L". The formation of this last section, resulting from the drop of the remainder of the textile element 9 does not require counting by the electronic device. The final drop enables the infrared cell 20 to detect the end of the textile element.

Figure 1:
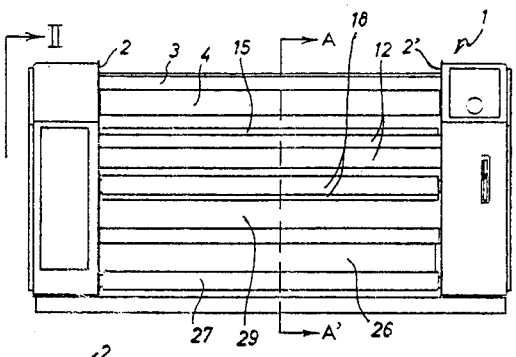
FIG. 1 is a front view of the drying and ironing device.
Figure 2:
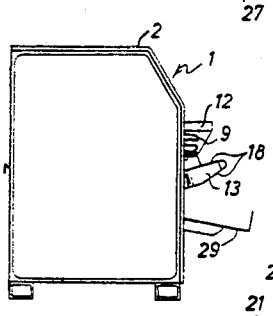
FIG. 2 is a lateral view of the drying and ironing device along the line II—II of FIG. 1.
Figure 9:
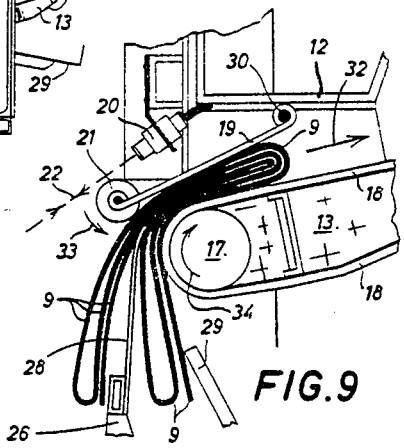
FIG. 9 shows an enlarged detail of FIG. 8, provided in order to give a more detailed illustration of the last stage of operation.

This detection simultaneously causes the rotation of the drive cylinder 17 and the translation of the endless strips 18, as well as the actuation of the electrical jack 25 which then rocks the folding blade 28 towards the front (to the right in FIG. 8), the blade then being straddled by the folded textile element 9, and applies it against the drive cylinder 17 which is rotating in the direction of the arrow 34 (FIG. 9). Consequently the folded textile element 9 is frictionally held between the drive cylinder 17, its associated bands 18 and the presser roll or wheels 21 rotating in the direction of the arrow 33, and is removed, in the direction of the arrow 32, on and by the guide path 13 on discharge from which it falls, in the direction of the arrow 31 (FIG. 8) into the collection container 29. The example in question relates to a textile element (a sheet) having a length "6L" which has been dried, ironed and folded. As the programming (adjustment) of the electronic device is determined by this length and the required number of folds, i.e. also by the length "L" of each section between successive folds, as well as by the manner in which folding should be commenced and termined (first and last sections of the same length "L" as the intermediate sections, as in the example described above, or one and/or the other of a length smaller than "L"), it is necessary to adjust the electronic device (number and frequency of the "pips" for each of the successive sequences, number of sequences, etc . . . ) for each particular case. It is however possible to partially dispense with this restriction by associating with the electronic device for gene rating and counting "pips" a microprocessor servosystem which enables the achievement, in particular by action on the frequency of transmission of the "pips", for a specific type of folding, a length of fold "L" which is constant whatever the length of the textile element to be folded and the speed of passage (which may be variable) of this textile element 9 through the drying and ironing system.

It should be noted that the saving in time obtained with this drying and ironing device in accordance with the invention is in particular due to the fact that the drying and ironing operations and the folding operation for the same textile element are not carried out separately and successively, one after the other, as in the case in the prior art, but that they are concomitant and only staggered in terms of time. In this regard, the portion of the textile element which has been dried and ironed being, on discharge from the drying and ironing system, is folded while the following portion is being dried and ironed.

I claim:

1. A drying and ironing device for the industrial treatment of long flat textile elements, said device comprising a casing, an engagement tank for the textile elements mounted at the front of the casing, a drying and ironing system mounted within said casing between the lateral flanks thereof and accessible from the front of the casing, said drying and ironing system comprising a heated cylinder, a guide path, mounted adjacent to said engagement tank inwardly thereof and comprising a frame about which endless drive strips are entrained, for delivering a textile element when the latter is discharged from the engagement tank, a drive cylinder, mounted near the discharge end of the guide path and adjacent said heated cylinder, for gripping the textile element when the latter is discharged from the guide path and for applying the textile element against the heated cylinder, a series of auxiliary cylinders disposed around the circumference of the heated cylinder from said drive cylinder to a discharge point constituted by the last auxiliary cylinder in the series in a direction measured from the drive cylinder around the circumference of the heated cylinder, and at least one endless belt disposed over the entire width of the heated cylinder and guided by said auxiliary cylinders such that the textile element is introduced between said endless belt and the heated cylinder and advances therebetween to the discharge point constituted by the last auxiliary cylinder for discharge from the drying and ironing system so as to hang down, after discharge, from the last auxiliary cylinder under the effect of gravity, and a system for folding the textile element and comprising a transverse folding blade, located beneath said last auxiliary cylinder and being fixed to a transverse support pivoting about a shaft which is disposed in a lower portion of the casing of the drying and ironing device directly below the discharge point of the drying and ironing system constituted by the last auxiliary cylinder and the longitudinal axis of which extends general parallel to the axis of the heated cylinder, electrical double-acting jack means for rocking said folding blade between two limit positions, means, for gripping and removing the textile element after the textile element has been folded through the action of said electrical double-acting jack means so as to straddle the folding blade, comprising a further guide path, extending outwardly of said casing beneath said engagement tank and formed by a plurality of endless strips entrained about a frame and driven by a further drive cylinder located at an input end of said further guide path in spaced relationship to an output end of said further guide path, and at least one presser roll bearing against said cylinder and disposed in a transversly oriented, freely rotatable manner at the end of a support member pivoting about a transverse axis located directly below the engagement tank, a receiver container disposed at the front of the casing under the further guide path and said engagement tank so as to receive the dried, ironed and folded textile element when the latter is discharged from the output end of said guide path, and means for automatically controlling said electrical jack means to provide rocking of the folding blade in one direction and then the other when the textile element, upon being discharged from the drying and ironing system, has unrolled by a given length corresponding to the formation of a fold on one side or the other of the folding blade, and to provide stopping and starting of the rocking of the folding blade at the end and beginning, respectively, of the process for folding the textile element, as well as for actuating said means for gripping and removing the folded textile element.

2. A drying and ironing device as claimed in claim 1, further comprising first and second transverse stops for limiting the angular movement of the folding blade between said two limit positions during the reciprocating movement of said blade, the first said stop being constituted by a rear support bar and the second stop being constituted by the further drive cylinder as maintained in the stop position therefor during the process for folding the textile element.

3. A drying and ironing device as claimed in claim 1 wherein said means for automatically rocking the folding blade, for starting and stopping the rocking of the folding blade, and for actuating said gripping and removing means comprises a detector for enabling detection of the beginning and end of the textile element when the textile element is discharged from the drying and ironing system and comprising at least one infrared transmitter-receiver cell disposed in the median plane of the drying and ironing device and oriented in said plane in such a way that the axis of transmission and reception of the infrared radiation contacts the textile element substantially at the level at which the textile element is gripped with a reciprocating movement by the upper edge of the folding blade.

* * * * *